US009454174B2

(12) United States Patent
Igarashi et al.

(10) Patent No.: US 9,454,174 B2
(45) Date of Patent: Sep. 27, 2016

(54) POWER SUPPLY VOLTAGE MONITORING CIRCUIT, AND ELECTRONIC CIRCUIT INCLUDING THE POWER SUPPLY VOLTAGE MONITORING CIRCUIT

(71) Applicant: Seiko Instruments Inc., Chiba (JP)

(72) Inventors: Atsushi Igarashi, Chiba (JP); Nao Otsuka, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 22 days.

(21) Appl. No.: 14/693,460

(22) Filed: Apr. 22, 2015

(65) Prior Publication Data

US 2015/0309528 A1 Oct. 29, 2015

(30) Foreign Application Priority Data

Apr. 25, 2014 (JP) ..... 2014-091924

(51) Int. Cl.
*G05F 5/00* (2006.01)

(52) U.S. Cl.
CPC ..... *G05F 5/00* (2013.01)

(58) Field of Classification Search
CPC ..... G05F 1/56; G05F 1/575; G05F 1/569; G05F 5/00
USPC ..... 323/273, 275, 276, 299, 303; 324/537, 324/764.01
See application file for complete search history.

(56) References Cited

U.S. PATENT DOCUMENTS 7,138,851 B2 * 11/2006 Sumita ..... G05F 3/205 327/332
8,604,821 B2 * 12/2013 Sugiura ..... H03K 19/0008 324/537
2010/0176839 A1 7/2010 Sugiura et al.
2014/0225438 A1 * 8/2014 Eguchi ..... G06F 1/26 307/23
2015/0124003 A1 * 5/2015 Mio ..... G09G 3/3406 345/690
2016/0105175 A1 * 4/2016 Ishimatsu ..... H03K 17/162 327/109

FOREIGN PATENT DOCUMENTS

JP 2010-166184 A 7/2010

* cited by examiner

*Primary Examiner* — Adolf Berhane
(74) *Attorney, Agent, or Firm* — Brinks Gilson & Lione

(57) ABSTRACT

Provided is a power supply voltage monitoring circuit capable of accurately detecting a power supply voltage with a small circuit scale and low power consumption. The power supply voltage monitoring circuit includes: a signal output circuit configured to output a signal voltage representing saturation characteristics with respect to an increase in power supply voltage; and a signal voltage monitoring circuit configured to output a signal representing that the signal voltage of the signal output circuit is normal, the signal voltage monitoring circuit including: a PMOS transistor including a gate connected to an output terminal of the signal output circuit; a first constant current circuit connected to a drain of the PMOS transistor; and an inverter including an input terminal connected to the drain of the PMOS transistor.

5 Claims, 5 Drawing Sheets

POWER SUPPLY VOLTAGE MONITORING CIRCUIT, AND ELECTRONIC CIRCUIT INCLUDING THE POWER SUPPLY VOLTAGE MONITORING CIRCUIT

RELATED APPLICATIONS

This application claims priority under 35 U.S.C. §119 to Japanese Patent Application No. 2014-091924 filed on Apr. 25, 2014, the entire contents of which is hereby incorporated by reference.

BACKGROUND OF THE INVENTION

1. Field of the Invention

The present invention relates to a power supply voltage monitoring circuit capable of decreasing a minimum operating power supply voltage in an electronic circuit so that the electronic circuit may operate with low voltage, and to an electronic circuit including the power supply voltage monitoring circuit.

2. Description of the Related Art

A related-art power supply voltage monitoring circuit is now described. FIG. 5 is a circuit diagram illustrating the related-art power supply voltage monitoring circuit. The related-art power supply voltage monitoring circuit includes a current source circuit 110, an impedance circuit 120, a bias voltage source 401, a comparator 402, a ground terminal 100, a power supply terminal 101, and an output terminal 102. The current source circuit 110 and the impedance circuit 120 form a signal output circuit 140. The bias voltage source 401 and the comparator 402 form a signal voltage monitoring circuit 130.

After a power supply voltage VDD is input to the power supply terminal 101, the signal output circuit 140 outputs a signal representing saturation characteristics with respect to the power supply voltage VDD, and the signal voltage monitoring circuit 130 compares the signal output from the signal output circuit 140 and the power supply voltage VDD to each other and outputs a signal representing that the signal output from the signal output circuit 140 is normal.

This configuration may decrease a minimum operating power supply voltage in an electronic circuit, thereby being capable of efficiently using the power supply voltage (see, for example, FIG. 1 of Japanese Patent Application Laid-open No. 2010-166184).

In the related-art power supply voltage monitoring circuit, however, the signal voltage monitoring circuit is formed by a comparator, and hence there is a problem in that the signal voltage monitoring circuit has a large circuit scale. Further, there is another problem in that the signal voltage monitoring circuit has high power consumption and it is difficult to decrease power consumption of the power supply voltage monitoring circuit.

SUMMARY OF THE INVENTION

The present invention has been made in view of the above-mentioned problems, and provides a power supply voltage monitoring circuit having a small circuit scale and low power consumption, and an electronic circuit including the power supply voltage monitoring circuit.

In order to solve the related-art problems, a power supply voltage monitoring circuit and an electronic circuit including the power supply voltage monitoring circuit according to one embodiment of the present invention are configured as follows.

The power supply voltage monitoring circuit includes: a signal output circuit configured to output a signal voltage representing saturation characteristics with respect to an increase in power supply voltage; and a signal voltage monitoring circuit configured to output a signal representing that the signal voltage of the signal output circuit is normal, the signal voltage monitoring circuit including: a PMOS transistor including a gate connected to an output terminal of the signal output circuit; a first constant current circuit connected to a drain of the PMOS transistor; and an inverter including an input terminal connected to the drain of the PMOS transistor.

According to the one embodiment of the present invention, the power supply voltage monitoring circuit capable of accurately detecting the power supply voltage with a small circuit scale and low power consumption may be provided.

DETAILED DESCRIPTION OF THE PREFERRED EMBODIMENTS

Now, a power supply voltage monitoring circuit and an electronic circuit including the power supply voltage monitoring circuit according to the present invention are described with reference to the accompanying drawings.

First Embodiment

Figure 1:
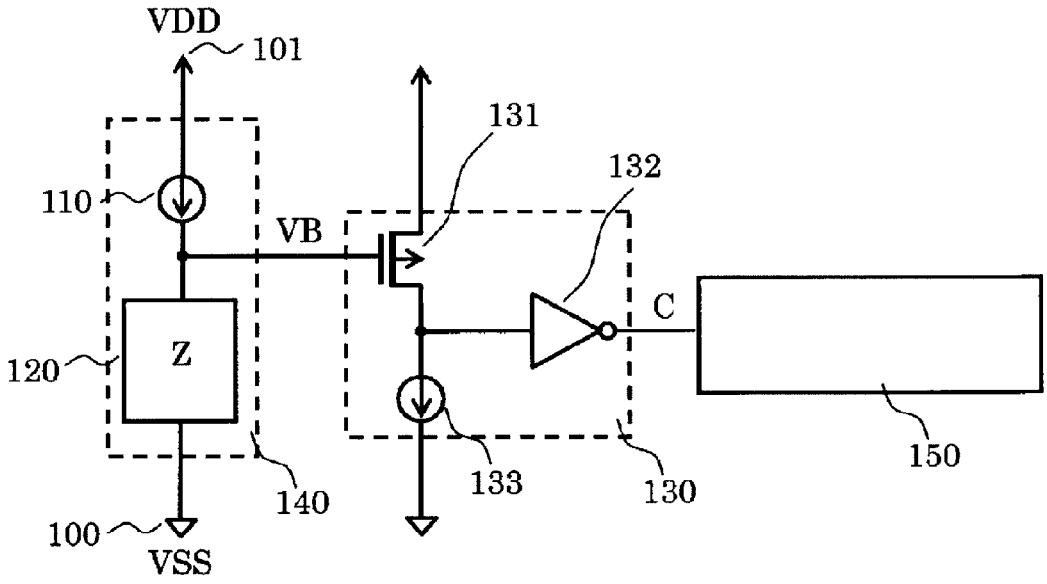
FIG. 1 is a circuit diagram of an electronic circuit including a power supply voltage monitoring circuit according to a first embodiment of the present invention.

FIG. 1 is a circuit diagram of an electronic circuit including a power supply voltage monitoring circuit according to a first embodiment of the present invention.

The electronic circuit including the power supply voltage monitoring circuit according to the first embodiment includes a signal output circuit 140, a signal voltage monitoring circuit 130, an application circuit 150, a power supply terminal 101, and a ground terminal 100. The signal output circuit 140 is formed by a current source circuit 110 and an impedance circuit 120. The signal voltage monitoring circuit 130 is formed by a PMOS transistor 131, a constant current circuit 133, and an inverter 132. The signal output circuit 140 and the signal voltage monitoring circuit 130 form the power supply voltage monitoring circuit.

Figure 2:
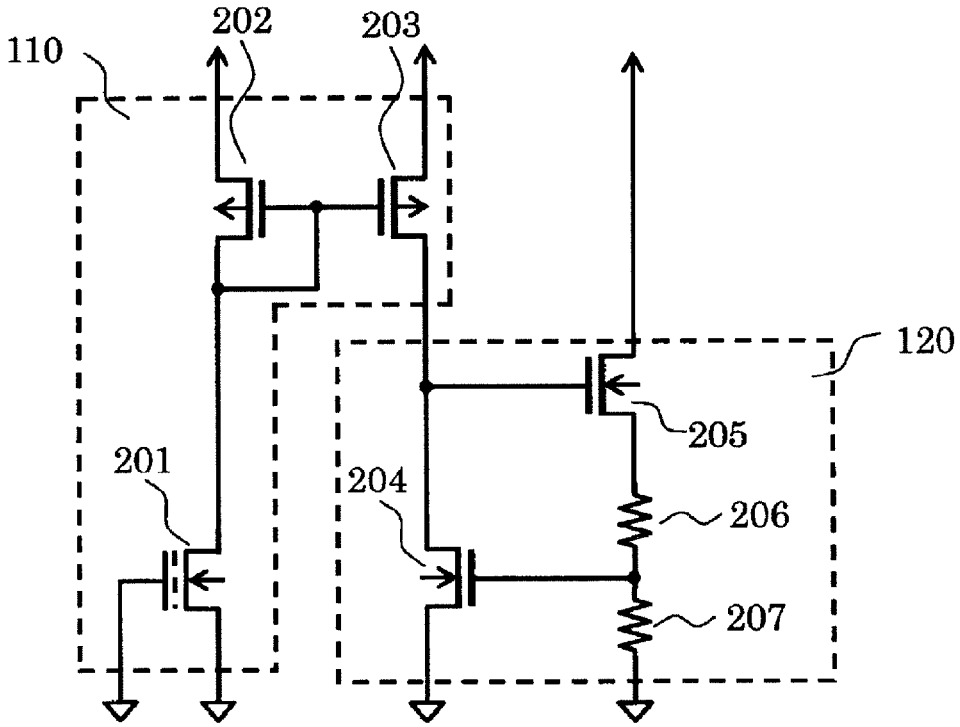
FIG. 2 is a circuit diagram of a signal output circuit included in the power supply voltage monitoring circuit according to the first embodiment.

FIG. 2 is a circuit diagram of the signal output circuit included in the power supply voltage monitoring circuit according to the first embodiment. The signal output circuit included in the power supply voltage monitoring circuit according to the first embodiment includes PMOS transistors 202 and 203, NMOS transistors 204 and 205, an NMOS depletion transistor 201, and resistors 206 and 207. The PMOS transistors 202 and 203 and the NMOS depletion transistor 201 form the current source circuit 110. The NMOS transistors 204 and 205 and the resistors 206 and 207 form the impedance circuit 120.

Connections in the power supply voltage monitoring circuit according to the first embodiment are described. The NMOS depletion transistor 201 has a gate and a source that are connected to the ground terminal 100, and a drain connected to a gate and a drain of the PMOS transistor 202. The PMOS transistor 202 has a source connected to the power supply terminal 101. The PMOS transistor 203 has a gate connected to the gate and the drain of the PMOS transistor 202, a drain connected to a gate of the PMOS transistor 131 and a gate of the NMOS transistor 205, and a source connected to the power supply terminal 101. The PMOS transistor 131 has a drain connected to an input terminal of the inverter 132 and a source connected to the power supply terminal 101. The NMOS transistor 205 has a drain connected to the power supply terminal 101 and a source connected to one terminal of the resistor 206. The resistor 207 has one terminal connected to the other terminal of the resistor 206, and the other terminal connected to the ground terminal 100. The NMOS transistor 204 has a gate connected to a connection point between the resistors 206 and 207, a drain connected to the gate of the NMOS transistor 205, and a source connected to the ground terminal 100. The constant current circuit 133 has one terminal connected to the input terminal of the inverter 132 and the other terminal connected to the ground terminal 100. The application circuit 150 has an input terminal connected to an output terminal of the inverter 132.

Figure 3:
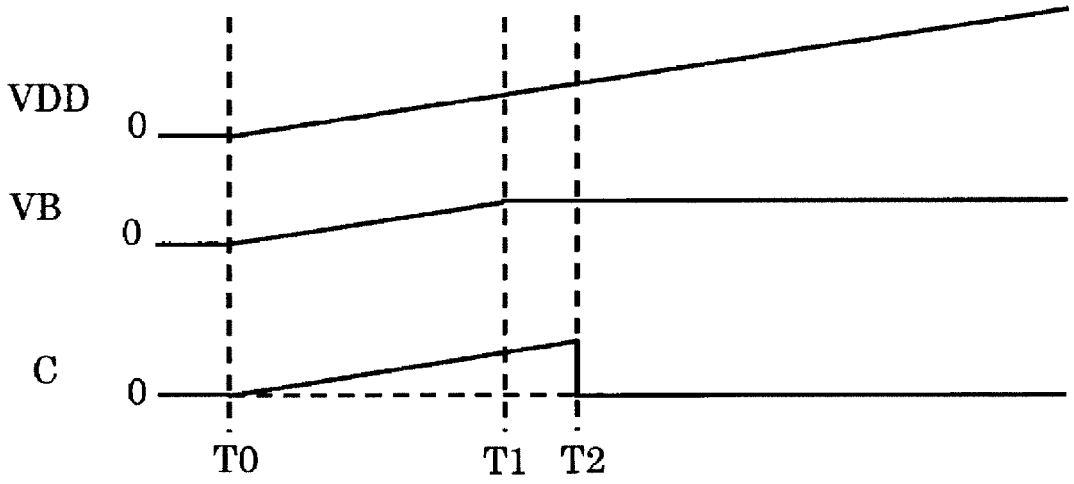
FIG. 3 is a timing chart illustrating an operation of the power supply voltage monitoring circuit according to the first embodiment.

Next, an operation of the power supply voltage monitoring circuit according to the first embodiment is described. The gate of the PMOS transistor 131 is referred to as "node VB", and the output terminal of the inverter 132 is referred to as "node C". FIG. 3 is a timing chart illustrating the operation of the power supply voltage monitoring circuit according to the first embodiment. A case is now considered in which a power supply voltage VDD is input to the power supply terminal 101.

When the power supply voltage VDD is input at a time T0, a current starts to flow through the NMOS depletion transistor 201, and a current that is proportional to the current flowing through the NMOS depletion transistor 201 is supplied to the impedance circuit 120 by the PMOS transistors 202 and 203 forming a current mirror circuit. In response to the current, the impedance circuit 120 generates a voltage, and increases a voltage of the node VB so as to follow the power supply voltage VDD. Because Low is input to the inverter 132, the inverter 132 outputs a signal of High to the node C.

Then, at a time T1, the node VB has a constant voltage. When the power supply voltage VDD further increases to be higher than the voltage of the node VB by a threshold voltage of the PMOS transistor 131 at a time T2, the PMOS transistor 131 is turned on to set the voltage of the node C to Low. The application circuit 150 starts its operation in response to the signal from the inverter 132.

In this manner, in response to the signal from the signal output circuit 140, the signal voltage monitoring circuit 130 outputs the output signal to the application circuit 150, and the application circuit 150 may be operated at a minimum operating voltage detected by the signal voltage monitoring circuit 130. Then, the minimum operating voltage of the signal voltage monitoring circuit 130 is determined based only on the PMOS transistor 131 and the constant current circuit 133, and hence the voltage of the signal voltage monitoring circuit 130 may be decreased. Further, the current flowing through the signal voltage monitoring circuit 130 is only the current from the constant current circuit 133, and hence power consumption may be decreased.

Note that, the application circuit 150 may be any electronic circuit, such as a comparator, an operational amplifier, and a temperature sensor, which starts its operation in response to the signal from the power supply voltage monitoring circuit. Further, the current source circuit 110 and the impedance circuit 120 are not limited to the configurations of FIG. 2, and may be any circuit that converts the current from the current source circuit 110 into a voltage by the impedance circuit 120.

As described above, the power supply voltage monitoring circuit according to the first embodiment may accurately detect the power supply voltage with a small circuit scale and low power consumption.

Second Embodiment

Figure 4:
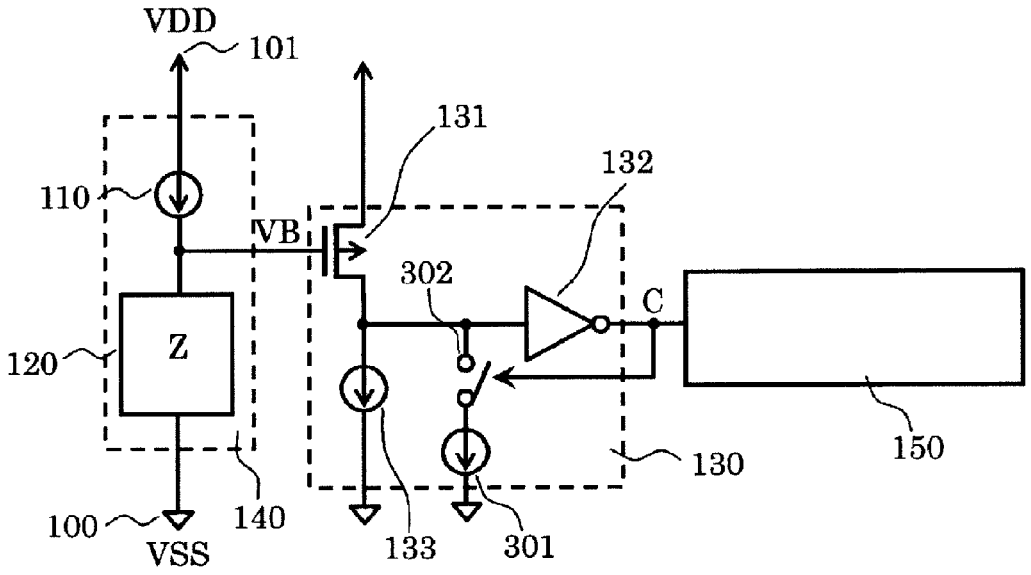
FIG. 4 is a circuit diagram of an electronic circuit including a power supply voltage monitoring circuit according to a second embodiment of the present invention.
Figure 5:
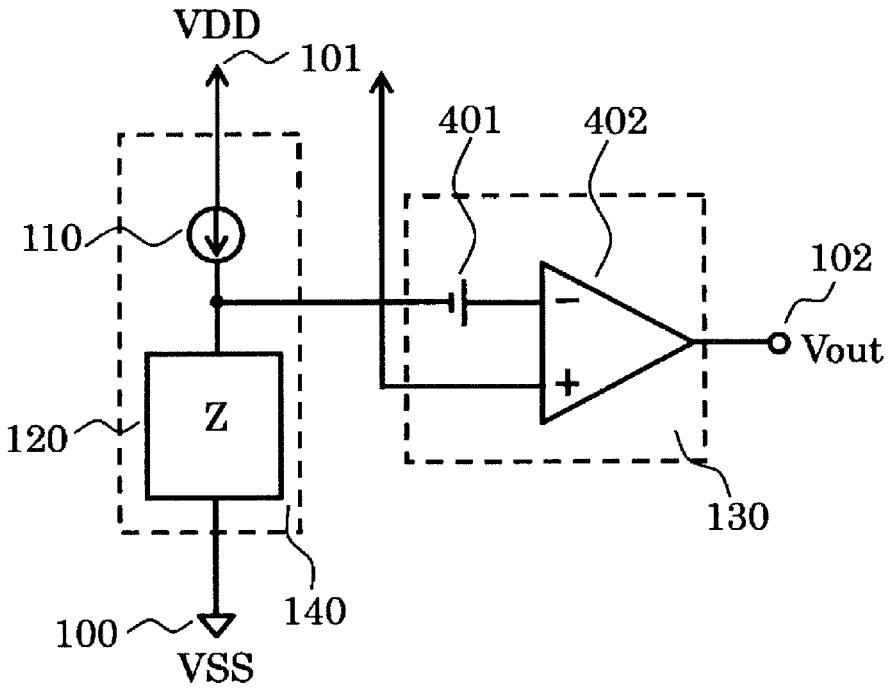
FIG. 5 PRIOR ART
FIG. 5 is a circuit diagram of a related-art power supply voltage monitoring circuit.

FIG. 4 is a circuit diagram of an electronic circuit including a power supply voltage monitoring circuit according to a second embodiment of the present invention. The difference from FIG. 1 resides in that a switch circuit 302 and a constant current circuit 301 are added. Connections are as follows. The switch circuit 302 has one terminal connected to the input terminal of the inverter 132 and the other terminal connected to one terminal of the constant current circuit 301. The switch circuit 302 is controlled to be turned on and off based on the output of the inverter 132. The other terminal of the constant current circuit 301 is connected to the ground terminal 100. The other connections are the same as those in FIG. 1.

An operation of the power supply voltage monitoring circuit according to the second embodiment is described. The switch circuit 302 is turned on from the time T0 to the time T2 of FIG. 3. Then, after the time T2, in response to the signal from the inverter 132, the switch circuit 302 is turned off so that the constant current circuit 301 is connected to the drain of the PMOS transistor 131. With this configuration, the threshold value of the PMOS transistor 131 may be changed so as to change the voltage at which the PMOS transistor 131 is turned off when the power supply voltage VDD decreases after the time T2. In this manner, hysteresis may be provided to the output signal of the power supply voltage monitoring circuit between when the power supply voltage VDD increases and when the power supply voltage VDD decreases. The other operations are the same as those in the first embodiment.

As described above, the power supply voltage monitoring circuit according to the second embodiment is capable of accurately detecting the power supply voltage with a small circuit scale and low power consumption. In addition, hysteresis may be provided to the output signal of the power supply voltage monitoring circuit.

What is claimed is:

1. A power supply voltage monitoring circuit, comprising:

a signal output circuit comprising:

a current source circuit; and an impedance circuit to be supplied with a current from the current source circuit, the signal output circuit being configured to output a signal voltage representing saturation characteristics with respect to an increase in power supply voltage; and a signal voltage monitoring circuit configured to receive the signal voltage from the signal output circuit to output a signal representing that the signal voltage is normal, the signal voltage monitoring circuit comprising:

a PMOS transistor including a gate connected to an output terminal of the signal output circuit;

a first constant current circuit connected to a drain of the PMOS transistor; and an inverter including an input terminal connected to the drain of the PMOS transistor.

2. A power supply voltage monitoring circuit according to claim 1, wherein:

the signal voltage monitoring circuit further comprises a switch circuit and a second constant current circuit that are connected in series to each other and in parallel to the first constant current circuit; and the switch circuit is controlled to be turned on and off based on an output of the inverter.

3. A power supply voltage monitoring circuit according to claim 1, wherein the impedance circuit comprises:

a first NMOS transistor including a gate connected to an output terminal of the signal output circuit;

a first resistor connected in series to a source of the first NMOS transistor;

a second resistor connected in series to the first resistor; and a second NMOS transistor including a gate connected to a connection point between the first resistor and the second resistor, and a drain connected to the output terminal of the signal output circuit.

4. A power supply voltage monitoring circuit according to claim 3, wherein:

the signal voltage monitoring circuit further comprises a switch circuit and a second constant current circuit that are connected in series to each other and in parallel to the first constant current circuit; and the switch circuit is controlled to be turned on and off based on an output of the inverter.

5. An electronic circuit, comprising the power supply voltage monitoring circuit according to claim 1.

* * * * *